US006487938B1

(12) United States Patent
Koegler

(10) Patent No.: US 6,487,938 B1
(45) Date of Patent: Dec. 3, 2002

(54) PAPER DRILL BIT

(75) Inventor: William A. Koegler, Waterloo (CA)

(73) Assignee: Dexter-Lawson Manufacturing Inc., Cambridge (CA)

( * ) Notice: Subject to any disclaimer, the term of this patent is extended or adjusted under 35 U.S.C. 154(b) by 43 days.

(21) Appl. No.: 09/689,875

(22) Filed: Oct. 13, 2000

Related U.S. Application Data

(60) Provisional application No. 60/159,502, filed on Oct. 15, 1999.

(51) Int. Cl.[7] ..... C21D 9/22
(52) U.S. Cl. ..... 76/108.1
(58) Field of Search ..... 76/108.1, 108.2, 76/104.1; 408/241 R, 1 R; 30/346.54, 350

(56) References Cited

U.S. PATENT DOCUMENTS 4,657,455 A * 4/1987 Rogers et al. ..... 409/235
4,887,493 A * 12/1989 Drake ..... 76/108.2
5,103,701 A * 4/1992 Lundin et al. ..... 82/173
5,129,289 A * 7/1992 Boland et al. ..... 30/346.54 X
5,150,636 A * 9/1992 Hill ..... 76/108.2
5,263,256 A * 11/1993 Trankiem ..... 30/346.54
5,456,327 A * 10/1995 Denton et al. ..... 175/371
5,875,636 A 3/1999 Kamody

FOREIGN PATENT DOCUMENTS

RU 1636460 3/1991

* cited by examiner

*Primary Examiner*—Douglas D. Watts

(57) ABSTRACT

There is provided a process for the treatment of a paper drill bit comprising the steps of subjecting the drill bit to deep cryogenic treatment, and coating the drill bit with a dry film fluorocarbon lubricant is a resin-bonded fluoropolymer coating.

12 Claims, 2 Drawing Sheets

Tool Life Results in Phase 1

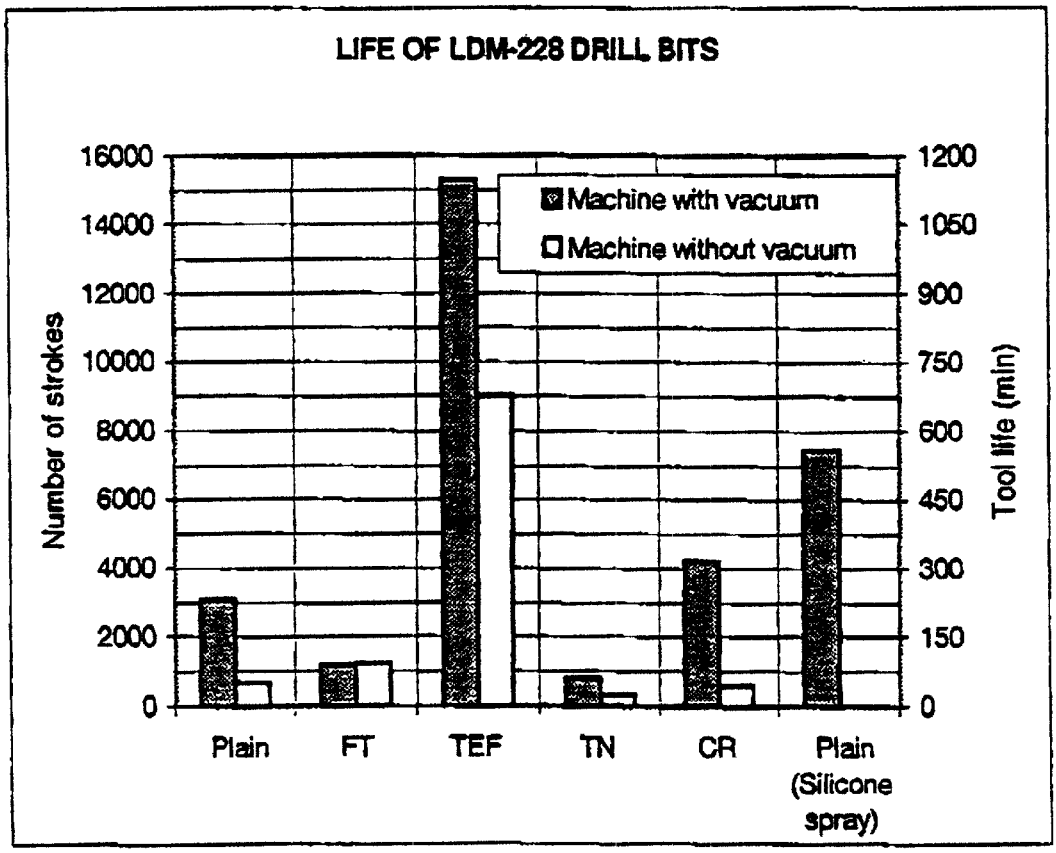
Figure 1. Tool Life Results in Phase 1

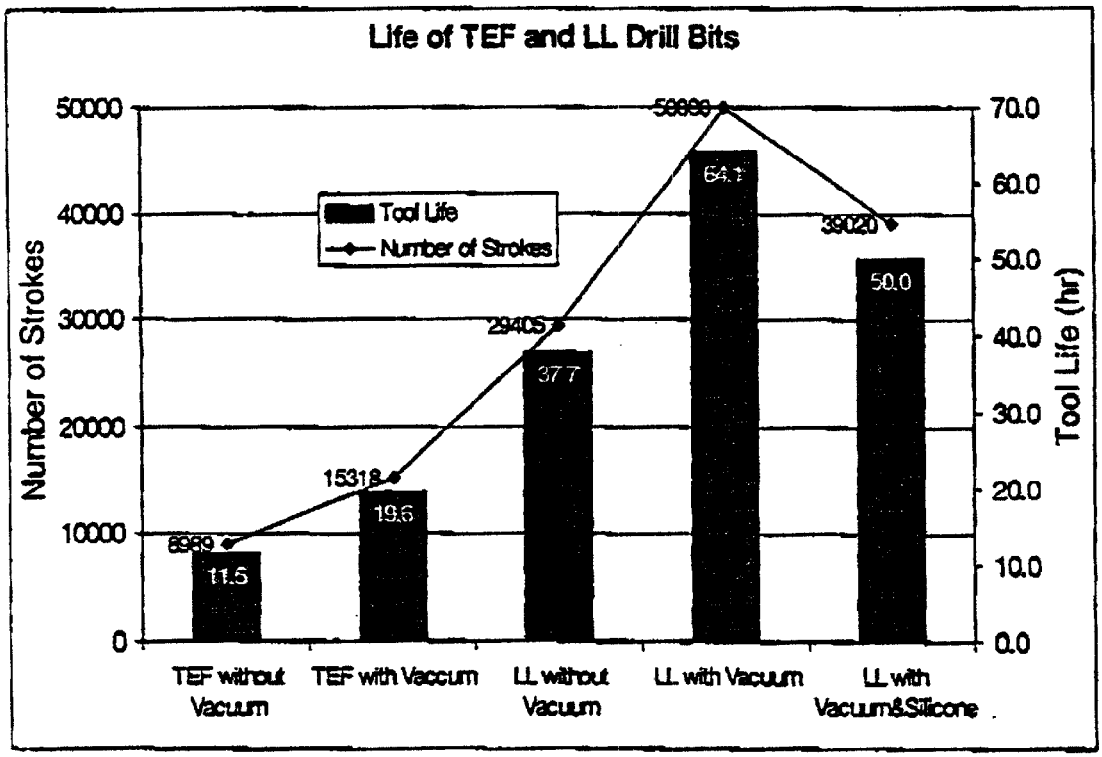
Figure 2. Tool Life Results in Phase 2

PAPER DRILL BIT

This application claims benefit of Provisional No. 60/159,502 filed Oct. 15, 1999.

FIELD OF THE INVENTION

The present invention relates to the field of paper drilling and more particularly relates to the manufacture of a drill bit for use in drilling through paper or other similar materials.

BACKGROUND OF THE INVENTION

Paper drilling machines can be used to drill holes in paper or other materials. In a paper drilling machine, the holes are drilled by a series of drill bits. The drill bits are positioned generally vertically and located above a horizontal surface on which the materials to be drilled are placed. After the material to be drilled has been placed on the paper drilling machine, the drill bits are rotated at high speed and lowered to engage the material and drill through it. Once the drill bits have completed drilling the holes, the drill bits are raised so as to permit the drilled material to be removed, and the drilled material is removed.

There is a need for a paper drill bit with improved wear characteristics.

SUMMARY OF THE INVENTION

It is an object of the invention to provide a drill bit which overcomes or mitigates at least one of the disadvantages of the prior art.

In a first aspect of the present invention, there is provided a process for the treatment of a drill bit comprising the steps of subjecting said drill bit to deep cryogenic treatment, and coating said drill bit with a dry film fluorocarbon lubricant. A preferred lubricant is a resin-bonded fluoropolymer coating.

More particularly, the deep cryogenic treatment comprises the steps of tempering a drill bit at about 375° F. for about two hours; cooling the drill bit slowly to ambient temperature; cooling the drill bit to approximately −120° F., and soaking the drill bit at about −120° F. until uniformly chilled; cooling the drill bit to about −300° F. to about −340° F. and maintaining the drill bit at about −300° F. for two hours per inch of thickness; warming the drill bit to about −175° F. and soaking the drill bit at −175° F. until uniform in temperature; warming the drill bit to ambient temperature and soaking the drill bit in still air until the drill bit is uniformly at ambient temperature; tempering the drill bit at about 375° F. by soaking the drill bit at about 375° F. for two hours; and cooling the drill bit to ambient temperature.

In another aspect of the present invention, coating the drill bit with a dry film fluorocarbon lubricant comprises the steps of cleaning the drill bit; immersing the drill bit in a bath of the dry film lubricant; removing the drill bit from the bath; allowing the drill bit to dry at ambient temperature; and baking the drill bit for at least one baking time period at a baking temperature sufficient to bake the dry film fluorocarbon lubricant onto the drill bit.

In yet another aspect of the present invention, the dry film fluorocarbon lubricant is a resin-bonded fluoropolymer coating.

More particularly, the dry film fluorocarbon lubricant is Emralon 305™ having a composition as follows, by volume:

| | |
|---|---|
| Ethanol | 20% |
| n-Butyl Alcohol | 20% |
| n-Amyl Acetate | 5% |
| Methanol | 5% |
| Phenol | 5% |
| Proprietary Fluoropolymer | 5% |
| Carbon Black | 5% |
| Xylene | 5% |
| Zinc Chromate | 5% |
| Methyl Ethyl Ketone | 20% |
| Isopropanol | 5% |
| Proprietary Hardener | 5% |

The foregoing composition is relative to the final product, and 5 percent is lost through evaporation.

It has been found important to remove cuttings by means of a vacuum device. Such vacuum device can also serve to cool the drill bit.

In a still further aspect of the invention there is provided a novel drill bit particularly adapted for drilling paper produced by the process of the invention.

BRIEF DESCRIPTION OF THE DRAWINGS

The present invention will now be described with reference to the accompanying drawings in which:

FIG. 1 is a graph showing the performance of various drill bits under a variety of operating conditions; and FIG. 2 is also a graph showing the performance of various drill bits, including the drill bit of the present invention under certain operating conditions.

DETAILED DESCRIPTION OF THE PREFERRED EMBODIMENT OF THE INVENTION

In a preferred embodiment, a process for the treatment of a drill bit comprises the steps of subjecting the drill bit to deep cryogenic treatment, and coating the drill bit with a dry film fluorocarbon lubricant.

Drill bits made of tool steel, typically plain tool steel having the composition 0.5% carbon, 0.25% silicon, 0.70% manganese, 3.25% chromium and 1.40% molybdenum, the balance iron, were subjected to the following treatments.

(a) Each drill bit was annealed in a vacuum furnace environment. Each drill bit was heated to about 1550° F., and soaked for one and one-half hours per inch of thickness, followed by cooling at about 25° F. per hour to about 900° F., in turn followed by air cooling to room temperature.

(b) After pre-heating to about 1250° F., each drill bit was heated to about 1760° F., and soaked at heat for about 45 to 60 minutes.

(c) Each drill bit was nitrogen quenched at 5 Bars over pressure to about 150° F. Tempering was done immediately after quenching.

(d) Each drill bit was subjected to double tempering. For each temper, each drill bit was soaked for two hours per inch of thickness at about 400° F. to a hardness of about 57 Rockwell "C". Each drill bit was air cooled to ambient temperature between tempers.

(e) Each drill bit was treated cryogenically to about −200° F. between the first and second temper.

For the purposes of the following discussion, and referring also to FIGS. 1 and 2, "plain tool steel" refers to steel which has undergone the processes of annealing and double tempering described above.

In a preferred embodiment of the present invention, each drill bit, comprised of plain tool steel, was first subjected to a deep cryogenic treatment. The deep cryogenic treatment comprised the following procedure:

(a) each drill bit was tempered at about 375° F., soaked at that temperature for two hours, and then cooled slowly to ambient temperature (for stress relief);

(b) each drill bit was soaked at about −120° F., until uniformly chilled;

(c) the temperature of each drill bit was then decreased to about −300° F. to about −340° F., and kept at that temperature for two hours per inch of thickness;

(d) each drill bit was soaked at about −175° F. until uniform in temperature;

(e) each drill bit was then soaked in still air until they were at ambient temperature; and (f) each drill bit was tempered at about 375° F. by soaking at that temperature for two hours, and then cooled slowly to ambient temperature (for stress relief).

Second, following the deep cryogenic treatment, each drill bit was coated with a dry film lubricant, such as the blend of fluorocarbon lubricants in an organic resin binder and solvent system sold under the trademark Emralon™ by Acheson Industries, Inc. Other similar dry film lubricants may be used. A resin-bonded fluoropolymer coating is preferred. Such coating was effected using the following procedure:

(a) cleaning each drill bit;

(b) immersing each drill bit in a bath of the dry film lubricant;

(c) removing each drill bit from the bath, and allowing each drill bit to dry at room temperature; and (d) baking each drill bit for one and one-half hours at about 300° F.

By way of example only, the composition of Emralon 305™, by volume, is as follows:

| | |
|---|---|
| Ethanol | 20% |
| n-Butyl Alcohol | 20% |
| n-Amyl Acetate | 5% |
| Methanol | 5% |
| Phenol | 5% |
| Proprietary Fluoropolymer | 5% |
| Carbon Black | 5% |
| Xylene | 5% |
| Zinc Chromate | 5% |
| Methyl Ethyl Ketone | 20% |
| Isopropanol | 5% |
| Proprietary Hardener | 5% |

The foregoing composition is relative to the final product, and 5 percent is lost through evaporation.

In another preferred embodiment, the dry film lubricant is a dry film fluorocarbon lubricant sold under the trademark Xylan 1010DF/Red™ by Whitford Corporation. In a preferred embodiment, the coating of Xylan 1010DF/Red™ is 15 to 25 microns. The steps of applying a coating of Xylan 1010DF/Red™ following the deep cryogenic treatment are as follows:

(a) cleaning each drill bit;

(b) immersing each drill bit in a bath of the dry film lubricant;

(c) removing each drill bit from the bath, and allowing each drill bit to dry at room temperature;

(d) baking each drill bit for one-half hour at about 450° F.; and (e) baking each drill bit for one hour at 300° F.

In the paper drilling machine in which the drill bits are used, cuttings can be removed by means of a vacuum device. Such vacuum device is known in the art. Such vacuum device, removing a maximum of 700 cubic feet per minute, is thought to improve drill bit performance because such vacuum can have a cooling effect on the drill bit.

In the paper drilling machine, silicone spray also can be sprayed on the drill bits when they are retracted from the material being drilled. The silicone sprayed in this way typically can have a composition which can include petroleum naphtha, and typically is sprayed as a fine mist.

The results of tests involving drill bits which had been subjected to various treatments, and used in certain various ways, are set out in FIG. 1 and FIG. 2. In FIG. 1, the test results for the following drill bits are set forth:

(a) the first category of drill bit is described as "plain", as described above as "plain tool steel", was used as a reference;

(b) the second category of drill bit is described as "FT", meaning drill bits which have been subjected to a "flame tipped" treatment;

(c) the third category of drill bit is described as "TEF", and comprises drill bits treated with Emralon, but not subjected to deep cryogenic treatment;

(d) the fourth category of drill bit is described as "TN", referring to drill bits which have been treated with titanium nitride;

(e) the fifth category of drill bit is described as "CR", and comprises drill bits subjected to deep cryogenic treatment, but not coated with Emralon. The results of a number of tests are set out in FIG. 1; and (f) the sixth category of drill bit is described as "Plain (Silicone spray)", and refers to drill bits comprised of "plain" tool steel (as described above) and sprayed with a silicone spray, as described above.

As can be seen from FIG. 1, the drill bits which had been coated with Emralon 305™ performed far better than those drill bits which had not been so treated. All of the drill bits referred to in Table 1 has been used until failure. The drill bit which had been coated with Emralon 305™ and used with a vacuum had failed after only 15,000 strokes.

Because of the test results described in FIG. 1, certain combinations of some of the treatments referred to in FIG. 1 were tested. The results of these further tests are set out in FIG. 2.

The only drill bit referred to in FIG. 2 which was not tested until failure was a drill bit which had been subjected to deep cryogenic treatment and coated with Emralon 305™, and which was used with a vacuum. After that drill bit completed 50,000 strokes, its testing was stopped.

The combination of deep cryogenic treatment of a drill bit and an Emralon 305™ coating, therefore appears to have resulted in the drill bit lasting for a surprisingly large number of strokes, when used with a vacuum. Such increased performance was not anticipated in light of the test results described in FIG. 1.

It will be apparent that, while presently preferred embodiments of the present invention are described herein, variations and modifications will occur to those skilled in the art and should not be considered as departing from the spirit of the invention.

I claim:

1. A process for the treatment of a drill bit comprising the steps of:

(a) subjecting said drill bit to deep cryogenic treatment; and (b) coating said drill bit with a dry film fluorocarbon lubricant.

2. The process as described in claim 1 in which said deep cryogenic treatment comprises the steps of:

(a) tempering a drill bit at about 375° F. for about two hours;

(b) cooling said drill bit slowly to ambient temperature;

(c) cooling said drill bit to approximately −120° F., and soaking said drill bit at about −120° F. until uniformly chilled;

(d) cooling said drill bit to about −300° F. and maintaining said drill bit at about −300° F. to about −340° F. for two hours per inch of thickness;

(e) warming said drill bit to about −175° F. and soaking said drill bit at about −175° F. until uniform in temperature;

(f) warming said drill bit to ambient temperature and soaking said drill bit in still air until said drill bit is at ambient temperature;

(g) tempering said drill bit at about 375° F. by soaking said drill bit at about 375° F. for two hours; and (h) cooling said drill bit to ambient temperature.

3. The process as described in claim 2 in which coating the drill bit with a dry film fluorocarbon lubricant comprises the steps of:

(a) cleaning the drill bit;

(b) immersing the drill bit in a bath of the dry film fluorocarbon lubricant;

(c) removing the drill bit from the bath;

(d) allowing the drill bit to dry at ambient temperature; and (e) baking the drill bit for at least one baking time period at a baking temperature sufficient to bake the dry film fluorocarbon lubricant onto the drill bit.

4. The process as described in claim 3 in which said dry film fluorocarbon lubricant is a resin-bonded fluoropolymer coating.

5. A process as described in claim 4 in which the baking time period is about one and one-half hours and the baking temperature is about 300° F.

6. A process as described in claim 5 in which the dry film fluorocarbon lubricant is Emralon 305™.

7. The process as described in claim 6 in which said resin-bonded fluoropolymer coating is Emralon 305™, having the following composition, by volume:

| | |
|---|---|
| Ethanol | 20% |
| n-Butyl Alcohol | 20% |
| n-Amyl Acetate | 5% |
| Methanol | 5% |
| Phenol | 5% |
| Proprietary Fluoropolymer | 5% |
| Carbon Black | 5% |
| Xylene | 5% |
| Zinc Chromate | 5% |
| Methyl Ethyl Ketone | 20% |
| Isopropanol | 5% |
| Proprietary Hardener | 5% |

8. The process as described in claim 7 which additionally comprises applying a vacuum for removing cuttings and cooling said drill bit.

9. A process as described in claim 4 in which the baking time periods comprise:

(a) about one-half hour, at a baking temperature of about 450° F.; and (b) about one hour, at a baking temperature of about 300° F.

10. A process as described in claim 9 in which the dry film fluorocarbon lubricant is Xylan 1010DF/Red™.

11. The process as described in claim 10 which additionally comprises applying a vacuum for removing cuttings and cooling said drill bit.

12. A drill bit produced by the process of claim 1.

* * * * *